United States Patent [19]

Antoszewski

[11] 4,074,884

[45] Feb. 21, 1978

[54] PIVOTED LOCKING WALL BRACKET

[75] Inventor: Alex Joseph Antoszewski, Michigan City, Ind.

[73] Assignee: Leigh Products, Inc., Coopersville, Mich.

[21] Appl. No.: 718,904

[22] Filed: Aug. 30, 1976

[51] Int. Cl.[2] ..... F16M 13/00

[52] U.S. Cl. ..... 248/289 R

[58] Field of Search ..... 248/289 R, 290; 211/96, 211/168

[56] References Cited

U.S. PATENT DOCUMENTS

| | | | |
|---|---|---|---|
| 417,959 | 12/1889 | Welton | 211/96 |
| 1,179,286 | 4/1916 | Crimmel | 248/289 |
| 1,213,808 | 1/1917 | Page | 248/290 |
| 3,357,670 | 12/1967 | Larson | 248/290 |

*Primary Examiner*—William H. Schultz

*Attorney, Agent, or Firm*—Price, Heneveld, Huizenga & Cooper

[57] ABSTRACT

A bracket mounted on a vertical surface has an anchor plate with a vertical, rearwardly opening channel for supporting an article carrying support arm having a vertical leg pivotally seated in the channel and an outwardly projecting leg for article support. The upper portion of the anchor plate, including the channel, is forwardly inclined along a horizontal fold line to form a downwardly recessed seat for the support arm. The recessed seat positively positions the arm to extend outwardly with respect to the vertical surface to which the anchor plate is attached. The bracket has a stored or retracted position wherein the outwardly projecting leg of the support arm is positioned between the vertical mounting surface and the forwardly inclined portion of the anchor plate so the support arm is stored parallel to the vertical surface.

11 Claims, 5 Drawing Figures

PIVOTED LOCKING WALL BRACKET

BACKGROUND OF THE INVENTION

1. Field Of The Invention

This invention relates to wall brackets and, in particular, to wall brackets having a movable support arm.

2. Prior Art

Prior art brackets provide an article supporting arm capable of being pivotally mounted to a vertical surface by a plate which permits the arm to be pivoted about a vertical axis. However, these brackets do not provide a simple and positive means of securing the arm against inadvertent pivotal movement in both extended and retracted positions. They also do not provide a means for holding the support arm in extended position which requires an intentional positive act such as lifting to permit displacement of the arm from extended, operating position.

SUMMARY OF THE INVENTION

A wall bracket includes an anchor plate mounted to a vertical surface and a support arm pivotally coupled to the anchor plate for pivotal movement between extended and retracted positions. Further, stability of the arm in either of the two positions is achieved with an advantageously simple anchor plate. The support arm can be positively secured in either an operating position, extending from the surface, or a storage or retracted position, flat against the surface. In both positions, gravity seats the support arm in recesses formed by the anchor plate.

More specifically, the anchor plate has a forwardly offset portion defining a vertical channel in the rear face of the anchor plate so the channel opens toward the vertical surface. The support arm has an outwardly projecting leg integrally coupled to a vertical leg rotationally seated in the vertical channel. The upper portion of the anchor plate, including the vertical channel, is forwardly inclined to form a downwardly recessed seat or socket for the support arm for holding the support arm, under the influence of gravity, in an outwardly projecting, operating position. The support arm can be positioned in a retracted or storage position by raising it sufficiently so the outwardly projecting leg clears the top of the anchor plate, rotating the support arm so it is flat against the mounting surface, and lowering the support arm so, under the influence of gravity, it wedges between the mounting surface and the forwardly inclined portion.

DETAILED DESCRIPTION OF THE PREFERRED EMBODIMENT

Figure 1:
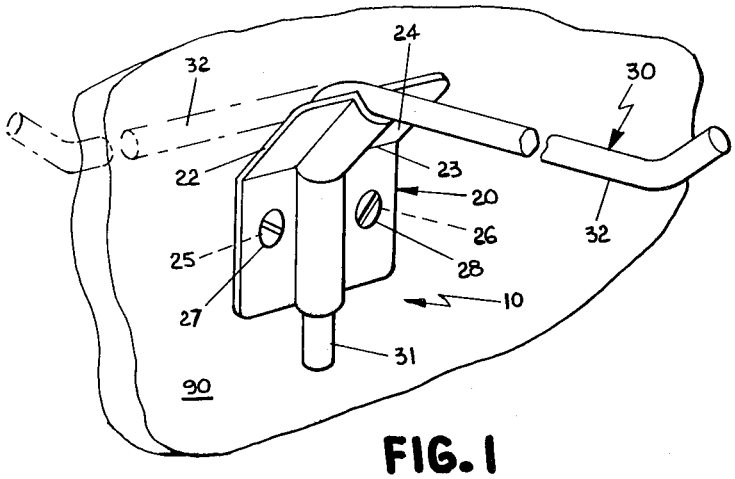
FIG. 1 is a frontal, perspective, broken view of a bracket in accordance with an embodiment of this invention showing the support arm in full lines in an operating position and in phantom lines in a stored position.

Referring to FIG. 1, a bracket 10 mounted on a vertical surface 90 includes an anchor plate 20 having a rearwardly opening, vertical, central channel 21 and a forwardly inclined channel 24 for receiving an elongated wire or rod-like support arm 30. The support arm 30 has an integral, vertical shank 31 substantially coaxial with and seated in channel 21 and an outwardly extending leg 32, projecting away from channel 21 and, in one position, partially seated within channel 24. The cross-sectional dimension of channel 21 is slightly larger than the cross section dimension of the vertical shank 31 permitting the vertical shank 31 to be rotated within central channel 21. Channel 21 is illustrated as U-shaped in cross section. The outer extremity of the extending leg 32 can have an upwardly sloping end portion 36 to improve the article retention ability of support arm 30.

Figure 2:
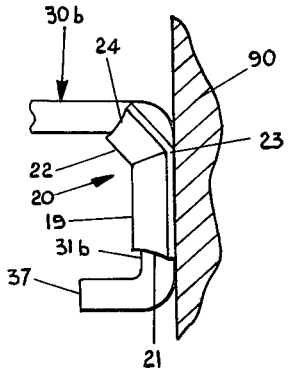
FIG. 2 is a fragmentary side elevation view of a bracket illustrated in FIG. 1.
Figure 3:
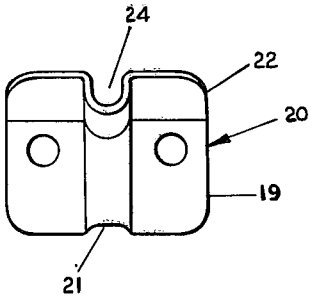
FIG. 3 is a front elevation view of the anchor plate of this invention.
Figure 4:
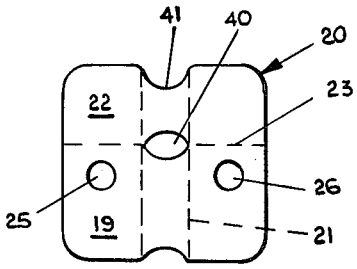
FIG. 4 is a front elevation view of the anchor plate prior to folding.

Referring to FIGS. 2, 3 and 4, anchor plate 20 includes a forwardly inclined upper portion 22, extending outwardly and upwardly from the vertical lower portion 19 and integral with the lower portion along a horizontal fold line 23 so the top of anchor plate 20 is spaced from the vertical mounting surface. Channel 24 is part of upper portion 22 and inclined with respect to channel 21. Thus, the open side of inclined channel portion 24 faces upwardly and rearwardly and angles away from channel 21 and the supporting surface 90. Openings 25 and 26 are formed through lower portions 19 of anchor plate 20 on either side of channel 21 and receive screws 27 and 28, respectively, for mounting anchor plate 20 to the vertical surface 90. Inclined channel 24 provides a seat or socket for a portion of outwardly extending leg 32 when support arm 30 is in an operating position. The wedge-like opening formed between the vertical surface 90 and the upper portion 22 provides an elongated seat for receiving leg 32 when support arm 30 is rotated to storage position, flat against the vertical surface 90.

It is particularly advantageous that support arm 30 can be readily and simply secured in either extended, operating or retracted storage positions and be positively secured in each position under the influence of gravity so support arm 30 does not accidentally swing from one position to the other. Providing for a secured storage position improves safety because support arm 30 does not inadvertently protrude to catch or otherwise harm passing objects or personnel. Nevertheless, even though supporting arm 30 can be safely secured, it is always available for use as a convenient article support means. As a result, convenient temporary or permanent storage is provided by a bracket in accordance with an embodiment of this invention.

Referring to FIG. 4, a rectangular, substantially flat piece of metal is used to fabricate anchor plate 20. A generally elliptical opening 40 is formed through the metal so with its longitudinal axis centered about the line at which the plate will be bent. This opening may be formed before, after or simultaneously with the forming of the channel 21. After the channel 21 has been formed, the upper portion 22 of anchor plate 20 is bent along the fold 23. A typical angle of bending is about 45°. If the upper portion 22 is bent such as to be substantially normal to the vertical surface 90, the plate will not effectively stabilize the arm 30 in retracted position. If the angle of forward inclination is too small, the pocket used to retain the retracted arm 30 will be too small to effectively hold the arm. Advantageously, elliptical opening 40 is so designed that when the bending is complete, the wall boundaries of the opening 40 engage each other. This arrangement provides a forwardly offset brace and pillar-like support for the inclined portion of the plate. The concave indention 41 at the end of the channel portion 24 forms a socket to closely fit about the outwardly extending leg 32, thus, positively stabilizing the arm 30 in extended position. Openings 25 and 26 are typically punched into anchor plate 20 on each side of and spaced from channel 21.

It is important that the radius of curvature of the arm 30 at the juncture of the leg 32 and the shank 31 be small enough that the arm 30 can seat into the socket formed by the channel in the inclined upper portion of the plate. Failure to do this will cause the arm to rest on the ridge formed at the fold line and the arm will have side play since it will not be firmly seated at the bottom of the socket formed at the end of the channel portion 24.

It will be recognized that the projecting article supporting portion of the bracket can have any number of configurations, depending upon the particular use to which it is to be put. For example, the horizontally extending leg 32 can be replaced with a hook as suggested by the arm 33 illustrated in FIG. 5. This figure also illustrates the fact that the load supporting leg can be either above or below the anchor plate.

Figure 5:
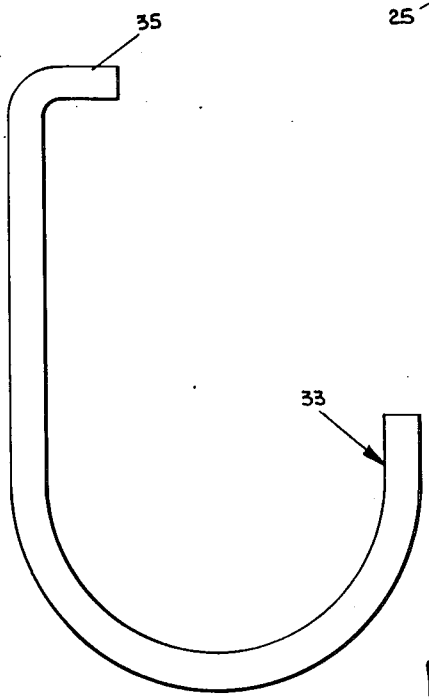
FIG. 5 is a side elevation view of a modified support arm for this invention.

The arm 30 illustrated in FIG. 1 has a straight shank and, thus, can be detached simply by being lifted out of the channel in the anchor plate. If removal is not desired, the lower end of the shank can be bent to limit vertical movement of the shank. When the load support leg is below the plate as illustrated in FIG. 5, the upper end of the shank must have an outwardly projecting extension 35 long enough to engage the socket at the end of the channel portion 24. It is necessary that the shank be long enough to permit the extension 35 to clear the top of the anchor plate.

OPERATION

Anchor plate 20 is mounted to vertical surface 90 by screws 27 and 28 installed through openings 25 and 26, respectively. If the support arm to be used in cooperation with anchor plate 20 cannot be passed through channel 21 after the anchor plate 20 is mounted, the support arm must be positioned within channel 21 before screws 27 and 28 are secured. Otherwise, after anchor plate 20 is mounted to vertical surface 90, support arm 30 can be installed by positioning vertical shank 31 within channel 21. To place support arm 30 in an operating position, it is lowered so outwardly extending leg 32 is seated within the inclined channel 24. To position support arm 30 in the stored position, outwardly extending leg 32 is raised so it clears upper portion 22 of anchor plate 20 and rotated so it is flat against vertical surface 90. Support arm 30 is then lowered so outwardly extending leg 32 seats against the inner wall face of upper portion 22 and is wedged against vertical surface 90.

The invention has the advantage of simplicity and low cost coupled with improved functional characteristics. The plate 20 can be fabricated on a punch press in one or at the most two operations. Fabrication of the arm 30 is a simple rod bending operation and no assembly is required at the point of manufacture. Despite this simplicity, the bracket has functional characteristics not available with existing brackets of this type.

Various modifications and variations will no doubt occur to those skilled in the art to which this invention pertains. For example, the particular connection of the anchor plate to the supporting surface may be varied from that disclosed herein. Also, the configuration of the support arm may be varied from that disclosed herein. These and all other variations which basically rely on the teachings through which this disclosure has advanced the art are properly considered within the scope of this invention as defined by the appended claims.

The embodiments of the invention in which an exclusive property or privilege is claimed are defined as follows:

1. In a bracket having a hook and a base plate adapted to be mounted to a vertical surface, said hook having an outwardly extending arm and a vertically extending leg; said base plate having an outwardly offset portion forming a channel in the back face thereof for receiving the leg of said hook, the improvement in said bracket comprising:

a segment of the metal forming said offset portion being removed, said removed portion being spaced from the top of said base plate; said base plate being bent outwardly to an inclined position about a line normal to the axis of said channel and extending laterally through the area of the removed portion to form an inclined pocket for seating said hook at the juncture of its arm and leg portions.

2. The bracket described in claim 1 wherein the walls defining the removed segment are pressed together to form a forwardly projecting pillar-like support for the forwardly inclined portion of said plate.

3. A bracket adapted for mounting on a vertical surface and having a support arm and an anchor plate, said anchor plate having a forwardly offset portion defining a channel in the rear face thereof having its axis in a vertical plane and said support arm having an outwardly projecting leg and a vertical shank, said vertical shank seated in said channel, the improvement in said bracket comprising:

the upper portion of said anchor plate including the forwardly offset portion thereof defining an upper portion of said channel being forwardly inclined away from the vertical surface with the axis of the upper portion of the channel being in the same vertical plane as the lower portion of the channel to form a downwardly recessed seat for said projecting leg for holding, under the influence of gravity, said support arm normal to the vertical surface to which said anchor plate is attached.

4. A bracket as recited in claim 2 wherein said upper portion of said anchor plate is forwardly inclined along a horizontal fold line and sufficiently spaced from the vertical surface when said anchor plate is mounted thereon to provide a wedge-like recess between the vertical surface and the rearwardly and upwardly facing surface of said upper portion for holding, in said recess under the influence of gravity, said projecting leg of said support arm in a stored position.

5. A bracket as recited in claim 4 wherein both portions of said channel have a U-shaped cross section and said support arm is made of a wire stock having a substantially circular cross section sufficiently small to fit within said channel.

6. A bracket as recited in claim 5 wherein said forwardly inclined upper portion of said anchor plate is at an angle of about 45° with respect to the plane of the remainder of said anchor plate.

7. A bracket as recited in claim 6 wherein the wall of said forwardly offset portion is substantially free of openings therethrough, has a substantially uniform thickness and has a line discontinuity aligned with said horizontal crease along which said upper portion of said anchor plate is forwardly inclined from the remainder of said anchor plate.

8. A bracket as recited in claim 7 wherein said supporting arm further includes an integral bottom curved portion projecting outwardly from the bottom extremity of said vertical shank for supporting an article; said vertical leg constrained to move within said channel and having sufficient length between said projecting leg and said bottom curved portion so said projecting leg can be lifted up to clear said anchor plate thereby permitting rotation of said support arm.

9. A bracket adapted for mounting on a vertical surface, the bracket having a support arm and an anchor plate, said support arm having a projecting leg and an integral vertical leg, said anchor plate having a forwardly offset portion including upper and lower segments, the lower segment thereof forming a channel in the rear thereof having its axis in a vertical plane for pivotally receiving the vertical leg of said support arm and for permitting the support arm to be moved between an extended operating position and a retracted position adjacent the vertical surface, said bracket characterized in that the upper portion of said bracket, including the upper segment of the forwardly offset portion, is forwardly inclined about a horizontal axis to form a recessed socket for receiving at least a portion of said projecting leg adjacent the juncture of said projecting leg and said vertical leg thereof for holding said support arm against pivotal movement in the extended operating position until said projecting leg thereof has been lifted out of said socket; and said forwardly inclined upper portion being sufficiently spaced from the vertical surface when said anchor plate is mounted thereon to provide an elongated wedge-like recess between the surface and the rearwardly and upwardly facing surface of said upper portion for holding in said recess, under the influence of gravity, said support arm in a stored position parallel to the vertical surface.

10. An anchor plate for mounting on a vertical surface, said plate having a forwardly offset portion forming a channel in the rear thereof the axis of which is in a vertical plane for rotationally receiving an elongated shank member, the upper portion of said plate including the upper portion of said channel being forwardly inclined about a fold line normal to the axis of said channel to form a downwardly recessed socket opening upwardly and rearwardly; a part of said offset portion having been removed in an area centered about the fold line joining the upper and lower portions of said plate, the upper and lower walls of the removed area being in contact with each other to form a forwardly projecting supporting pillar for said inclined upper portion.

11. An anchor plate as recited in claim 10 wherein said upper portion is inclined forwardly approximately 45° and the forward end of said channel portion in said upper portion is concavely indented to increase the depth of the socket formed at said end of said channel.

* * * * *